US006756107B1

(12) United States Patent
Schierz et al.

(10) Patent No.: US 6,756,107 B1
(45) Date of Patent: Jun. 29, 2004

(54) MOUNTING MAT FOR MOUNTING AN EXHAUST-GAS CATALYTIC CONVERTER

(75) Inventors: Claus Schierz, Freiberg (DE); Bernhard Kohlsdorf, Niederschöna (DE)

(73) Assignee: ASGLAWO GmbH-Stoffe zum Daemmen und Verstaerken, Hilbersdorf (DE)

( * ) Notice: Subject to any disclaimer, the term of this patent is extended or adjusted under 35 U.S.C. 154(b) by 0 days.

(21) Appl. No.: 09/600,847

(22) PCT Filed: Dec. 14, 1999

(86) PCT No.: PCT/EP99/09881

§ 371 (c)(1),
(2), (4) Date: Jul. 24, 2000

(87) PCT Pub. No.: WO00/36284

PCT Pub. Date: Jun. 22, 2000

(30) Foreign Application Priority Data

Dec. 16, 1998 (DE) ..... 198 58 023
Mar. 13, 1999 (DE) ..... 199 11 247

(51) Int. Cl.[7] ..... B32B 3/02; B32B 7/08; B32B 31/02

(52) U.S. Cl. ..... 428/192; 428/102; 57/246; 57/254; 156/93

(58) Field of Search ..... 428/102, 192, 428/369; 57/246, 254; 156/93

(56) References Cited

U.S. PATENT DOCUMENTS

| | | | |
|---|---|---|---|
| 4,011,651 | A | 3/1977 | Bradbury |
| 5,028,397 | A | 7/1991 | Merry |

FOREIGN PATENT DOCUMENTS

| | | |
|---|---|---|
| DE | 9311571 | 11/1993 |
| EP | 0 192 417 | 8/1986 |
| EP | 0 328 293 | 8/1989 |
| WO | 91 19082 | 12/1991 |

*Primary Examiner*—Alexander S. Thomas
(74) *Attorney, Agent, or Firm*—Collard & Roe, P.C.

(57) ABSTRACT

A bearing mat for supporting an exhaust gas catalyst is configured as a binding agent-free, multi-layered flat structure made of thermally stable threads mechanically reinforced by quilting seams. The threads consist of a crimped yarn composed of filaments and are fixed in the flat structure by the quilting seams under tensile stress. The quilting seams are sewn using a thread whose thermal stability is lower than the mat's operating temperature. A process for producing the mat is also provided, in which crimped yarn composed of thermally stable filaments is withdrawn from rolls in several strands and placed under tension on a transporting device moving transversely to the take-off direction in order to form a multi-layered flat structure. The flat structure moved forward by the transporting device is mechanically reinforced with quilting seams so that the threads remain under tension after the flat structure is removed from the transporting device.

5 Claims, 1 Drawing Sheet

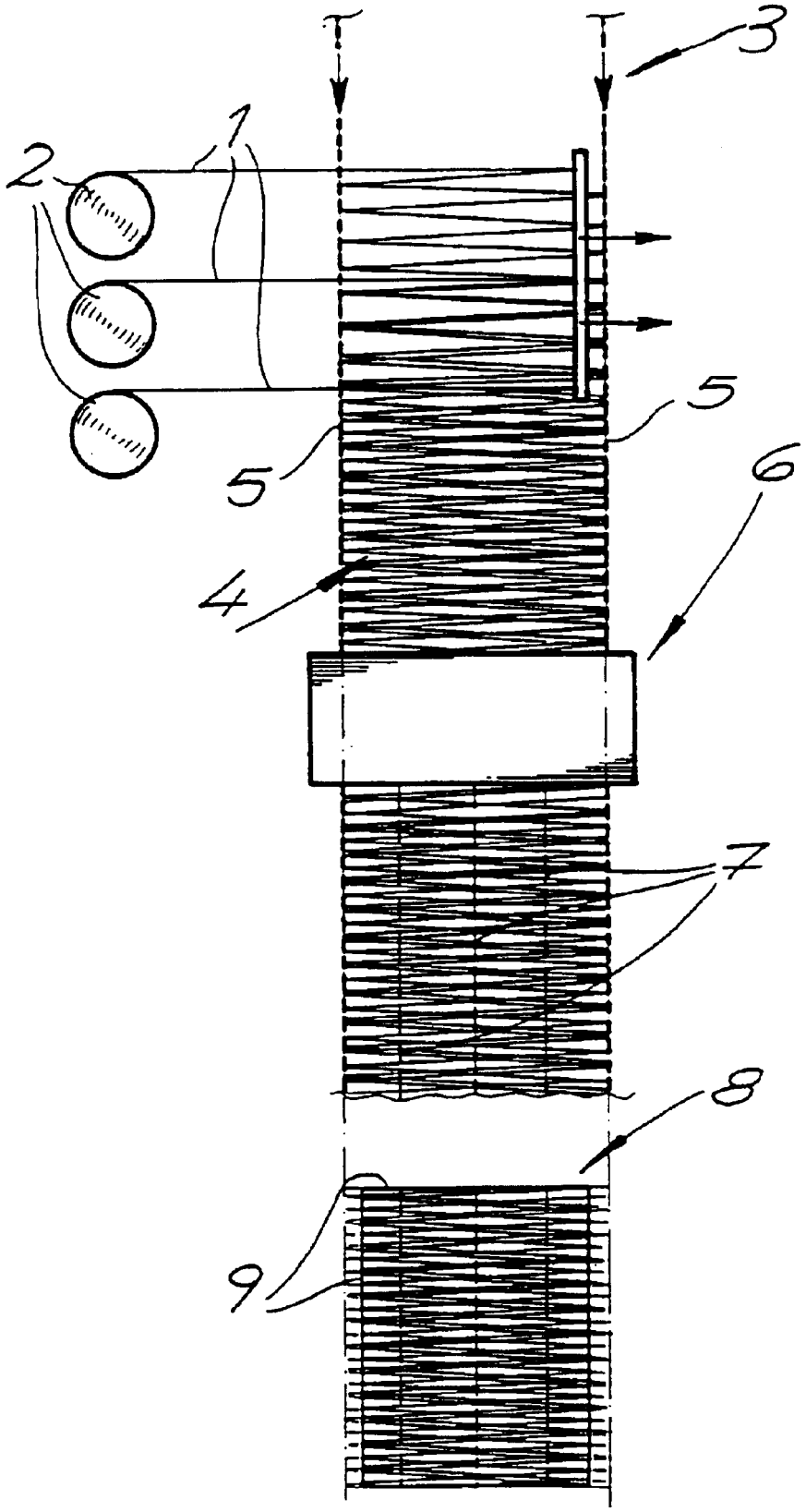
T
T
3
1
2
5
5
6
4
7
8
9

MOUNTING MAT FOR MOUNTING AN EXHAUST-GAS CATALYTIC CONVERTER

CROSS REFERENCE TO RELATED APPLICATIONS

Applicants claim priority under 35 U.S.C. §119 of German Application No. 198 58 023.1 filed on Dec. 16, 1998 and German Application No. 199 11 247.9 filed on Mar. 13, 1999. Applicants also claim priority under 35 U.S.C. §365 of PCT/EP 99/09881 filed on Dec. 14, 1999. The international application under PCT article 21(2) was not published in English.

BACKGROUND OF THE INVENTION

1. Field of the Invention

The invention relates to a bearing mat for supporting in a metallic catalyst housing an exhaust gas catalyst for cleaning motor vehicle exhaust gases. The bearing mat is arranged on the periphery of the ceramic carrier body of an exhaust gas catalyst and seals the annular gap between the ceramic carrier body and the catalyst housing consisting of a metallic material. Said bearing mat is intended to permit a safe and vibration-free support of the ceramic carrier body and has to compensate any change occurring in the width of the annular gap to be sealed when the metallic catalyst housing expands at the operating temperature preset by the combustion exhaust gases. Furthermore, the bearing mat forms a heat-insulating layer on the inner wall of the catalyst housing and reduces the outwardly transmitted sonic noise generated by the flowing exhaust gases.

2. Prior Art

Within the framework of the measures known, the bearing mat consists of short inorganic fibers, an organic binding agent, as well as embedded particles consisting of expanding material, for example mica or vermiculite, which expands under the influence of heat and causes the volume of the bearing mat to increase at the operating temperature. The inorganic fibers embedded in the binding agent consist of ceramic staple fibers or crushed $SiO_2$ filaments with an average length of a few millimeters (DE-U 93 11 571). A bearing mat with short inorganic fibers exhibits a tendency to erosion and abrasion. The fibers as well as the particulate expanding material are discharged together with the flowing combustion exhaust gases, with the consequence that sealing of the annular gap deteriorates and erosion increases. When a fiber material made of longer filaments is used, there is the risk of fibers being blown out, though only to a lesser extent. However, the formation of bridges and cross-linkage of the filaments obstruct expansion of the mat and the effect of the expanding material is prevented from becoming fully effective. Finally, there is the problem that the expanding property of vermiculite and mica starts to take effect only at high temperatures. The known supporting mats are not suitable or suitable only to a limited extent for exhaust gas catalysts employed for cleaning the combustion exhaust gases of diesel engines because the exhaust temperatures occurring with diesel fuel are inadequate for initiating an expanding effect of the bearing mat.

SUMMARY OF THE INVENTION

The invention is based on the problem of proposing a bearing mat for exhaust gas catalysts that is safely prevent d from being blown out and which effectively seals the annular gap between the exhaust gas catalyst and the catalyst housing both at low and high exhaust gas temperatures.

The problem is solved according to th invention by a bearing mat in the form of a binding agent-free, multi-layered flat structure consisting of heat-stable threads, said flat structure being mechanically reinforced by quilting seams, whereby the threads consist of a crimped yarn of filaments and are fixed by the quilting seams in the flat structure under tensile stress; and the quilting seams are produced with a sewing thread with a thermal stability that is lower than the operating temperature of the bearing mat.

Methods for reshaping unstructured filament yarns into crimped, textured yarns with a textile appearance are known. The resulting crimped yarns are voluminous and characterized by high elasticity. According to the invention, the threads consisting of a crimped yarn are laid under tensile stress to form a flat structure that has the usual thickness of bearing mats. The threads are fixed within the flat structure by quilting seams, whereby the tensile stress is maintained. The sewing thread used for the quilting seams consists of a material whose thermal stability is lower than the operating temperature of the bearing-mat. When the bearing mat installed in the housing of the catalyst is heated for the first time to the operating temperature preset by the combustion exhaust gases, the quilting seams are destroyed, whereby deformation energy stored in the crimped yarn is being released as the tensile stress of the thermally stable threads is being relieved. The liberated deformation energy is substantial and permits a considerable increase in the volume of the flat structure. The sealing power of the bearing mat installed between the catalyst housing and the exhaust gas catalyst is accordingly high as soon as the quilting seams have been destroyed when the bearing mat is heated to the operating temperature for the first time. The increase in volume of the bearing mat as defined by the invention, which starts with the dissolution of the quilting seams, is not dependent upon the temperature.

Therefore, the bearing mat as defined by the invention can be employed in connection with both exhaust gas catalysts that are operated with relatively low temperature, and with exhaust gas catalysts for hot combustion exhaust gases, as usually found with Otto engines. Owing to the fact that the bearing mat as defined by the invention contains neither expanding material in the form of particles, nor fractured pieces of fiber material, but exclusively consists of long filament threads, the risk of any erosion or abrasion caused by the flowing combustion exhaust gases is low.

The crimping yarn preferably consists of $SiO_2$ filaments and/or filaments made of textile glass and/or $Al_2O_3$-containing inorganic filaments. However, other crimped yarns having high thermal stability and consisting of organic or inorganic materials are not to be excluded. According to a further development of the invention, the latter teaches that seams consisting of a thermally stable thread are provided on the cutting edges of the bearing mat. The seams on the cutting edges produced with a thermally stable thread material assure additional edge protection and contribute to a further improvement in preventing the blowing out in the bearing mat of the invention. Suitable are threads that still have adequate tensile strength at the operating temperature of the bearing mat. Considered can be threads made of textile glass, $SiO_2$, metals and the like.

Furthermore, the object of the invention is a process for producing the bearing mat with the following features:

(a) Crimped yarn consisting of thermally stable filaments is taken off from rolls in a plurality of strands and laid under tensile stress on a transporting device moving transversely to the direction of pull-off to form a plane, multi-layered flat structure.

(b) The flat structure, which is moved on with the transporting device, is mechanically reinforced with quilting seams in such a way that the threads of the flat structure continue to be under tensile stress when the flat structure is removed from the transporting device.

(c) A sewing thread is employed for the quilting seams that has a thermal stability which is lower than the operating temperature of the bearing mat.

As a further development of the invention, the latter provides the instruction that mats are punched from the continuous web, the latter having been mechanically reinforced with quilting seams, and that prior to or after the punching process, seams are applied within the zone of the cutting edges, using a thread consisting of a thermally stable material.

BRIEF DESCRIPTION OF THE DRAWINGS

The invention is explained in the following with the help of the drawing showing only one exemplified embodiment. The single drawing shows a flow diagram of the process for producing bearing mats for exhaust gas catalysts.

DETAILED DESCRIPTION OF THE INVENTION

In a first process step of the manufacturing process shown in the FIGURE, crimped yarn consisting of inorganic filaments is pulled off from the rolls 2 in a plurality of strands 1 and deposited under tensile stress on a transporting device 3 moving transversely to the direction of take-off, in order to form a plane, multi-layered flat structure 4. As the strands 1 are being laid, they are hooked into the edge-side chains 5 of the transporting device 3. The tensile stress in the strands 1 is maintained in this way. The thickness of the flat structure depends on the type of use. Bearing mats with a thickness of just a few millimeters up to a few centimeters are used depending on the diameter and weight of the catalyst for which the bearing mat is intended. The thickness of the flat structure is adjusted accordingly.

The transporting device 3 passes through a station 6, in which the flat structure 4 is mechanically reinforced with quilting seams 7 in such a way that the threads of the flat structure continue to be under tensile stress when the flat structure 4 is removed from the transporting device 3. A sewing thread is employed for the quilting seams 7 that has a thermal stability which is lower than the operating temperature of the bearing mat.

In a last process step, mats 8 are punched out from the continuous web that has been mechanically reinforced with quilting seams 7, whereby prior to or after the punching process, seams 9 are applied within the zone of the cutting edges, using a thread consisting of a thermally stable material.

It is understood that the material web mechanically reinforced with quilting seams can also first be wound to an endless ribbon, and that the individual mats can then be produced by punching processes at the location of the customer.

The process shown in the FIGURE is employed for producing binding agent-free bearing mats for supporting exhaust gas catalysts. Said bearing mats consist of a multi-layered flat structure made of inorganic threads, which is mechanically reinforced by quilting seams. It is important for the predetermined function of the bearing mat that the threads consist of a crimped yarn consisting of filaments; that said threads are fixed in the flat structure under tensile stress by the quilting seams; and that the quilting seams are produced with a sewing thread having a thermal stability lower than the operating temperature of the bearing mat. The crimped yarn preferably consists of $SiO_2$ filaments and/or filaments made of textile glass and/or $Al_2O_3$-containing filaments. Synthetic sewing threads which are not heat-stable and which are destroyed when the bearing mat is heated to the operating temperature are used for the quilting seams. The destruction of the sewing threads liberates deformation energy of the crimped yarn, whereby the volume of the bearing mat expands and the sealing force of the bearing mat clamped between the catalyst and the catalyst housing increases.

What is claimed is:

1. A bearing mat for supporting an exhaust gas catalyst in a metallic catalyst housing used for cleaning motor vehicle exhaust gases, characterized by a binding agent-free, multi-layered flat structure consisting of thermally stable threads, said flat structure being mechanically reinforced by quilting seams, whereby the threads consist of a crimped yarn consisting of filaments and are fixed under tensile stress in the flat structure by the quilting seams; and the quilting seams are produced with a sewing thread having a thermal stability lower than the operating temperature of the bearing mat.

2. The bearing mat according to claim 1, characterized in that the crimped yarn consists of $SiO_2$ filaments and/or filaments made of textile glass and/or $Al_2O_3$ containing inorganic filaments.

3. The bearing mat according to claim 1, characterized in that provision is made for seams on the cutting edges of the bearing mat, said seams consisting of a thermally stable thread, for example textile glass.

4. A process for producing a bearing mat according to claim 1, whereby crimped yarn consisting of thermally stable filaments is pulled off from rolls (2) in a plurality of strands (4) and placed under tensile stress on a transporting device (3) moving transversely to the direction in which they are pulled off for forming a plane, multi-layered flat structure;

the flat structure (4) moved along by the transporting device (3) is mechanically reinforced with quilting seams (7) in such a way that the threads of the flat structure continue to be under tensile stress when the flat structure (4) is removed from the transporting device (3); and a sewing thread is used for the quilting seams (7) having a thermal stability lower than the operating temperature of the bearing mat.

5. The process according to claim 4, whereby mats (8) are punched out of the continuous web mechanically reinforced with quilting seams (7), and that prior to or after the punching process, seams (9) are applied within the zone of the cutting edges, using a thread consisting of a thermally stable material.

* * * * *